US009332620B2

(12) United States Patent
Shin

(10) Patent No.: US 9,332,620 B2
(45) Date of Patent: May 3, 2016

(54) LIGHTING DEVICE, LIGHTING SYSTEM INCLUDING THE SAME, AND METHOD OF OPERATING THE SAME

(71) Applicant: LG INNOTEK CO., LTD., Seoul (KR)

(72) Inventor: Ki Won Shin, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 115 days.

(21) Appl. No.: 13/654,163

(22) Filed: Oct. 17, 2012

(65) Prior Publication Data

US 2013/0093329 A1 Apr. 18, 2013

(30) Foreign Application Priority Data

Oct. 17, 2011 (KR) ..... 10-2011-0106114

(51) Int. Cl.
*G09G 3/36* (2006.01)
*H05B 37/02* (2006.01)
*G09G 3/34* (2006.01)

(52) U.S. Cl.
CPC ..... *H05B 37/0272* (2013.01); *G09G 3/3406* (2013.01); *H05B 37/0227* (2013.01)

(58) Field of Classification Search
CPC ..... G09G 2360/16; G09G 3/34–3/3426; G09G 2320/0606; G09G 2320/0626; G09G 2320/0646; G09G 2320/0653; G09G 2320/0285; G09G 2320/062; G02F 1/133602–1/133611; H04N 5/144
USPC ..... 345/102; 348/470
See application file for complete search history.

(56) References Cited

U.S. PATENT DOCUMENTS 7,982,726 B2 * 7/2011 Kim et al. ..... 345/204
8,588,576 B2 * 11/2013 Yoshitani et al. ..... 386/200
2002/0038157 A1 3/2002 Dowling et al.
2004/0263494 A1 * 12/2004 Poor ..... A63F 13/10 345/204
2007/0063961 A1 * 3/2007 Kuroki ..... 345/102
2008/0284719 A1 * 11/2008 Yoshida ..... 345/102
2011/0148943 A1 * 6/2011 Seo et al. ..... 345/690

FOREIGN PATENT DOCUMENTS

JP 2004501497 A 1/2004
JP 2008-059846 A 3/2008
JP 2011-199858 A 10/2011
WO WO 2011105579 A1 * 9/2011

OTHER PUBLICATIONS

Office Action dated May 4, 2015 in Korean Application No. 10-2014-0135231.

* cited by examiner

*Primary Examiner* — Stephen Sherman
(74) *Attorney, Agent, or Firm* — Saliwanchik, Lloyd & Eisenschenk

(57) ABSTRACT

Disclosed are a lighting device, a lighting system including the same, and a method of operating the same. The lighting device includes a communication unit receiving contents through communication with an outside, a content analyzing unit detecting an output state of the contents by analyzing the contents received through the communication unit, a storage unit storing information of a driving condition of a lighting unit corresponding to the output state of the contents, a controller extracting the information of the driving condition of the lighting unit corresponding to the detected output state of the contents from the storage unit and allowing the lighting unit to operate according to the contents based on the information of the driving condition of the lighting unit, and a lighting unit driver outputting a driving signal used to drive the lighting unit according to a control signal of the controller.

3 Claims, 12 Drawing Sheets

LIGHTING DEVICE, LIGHTING SYSTEM INCLUDING THE SAME, AND METHOD OF OPERATING THE SAME

CROSS-REFERENCE TO RELATED APPLICATIONS

The present application claims priority under 35 U.S.C. 119 and 35 U.S.C. 365 to Korean Patent Application No. 10-2011-0106114 (filed on 17 Oct. 2011), which is hereby incorporated by reference in its entirety.

BACKGROUND

The disclosure relates to a lighting device. In more particular, the disclosure relates to a lighting device to control the operating state of a lighting unit according to a broadcasting signal, a lighting system including the same, and a method of operating the same.

A lighting device has been used for various purposes. In particular, the lighting device has been used for general lighting for interior design, stage lighting used to create a specific atmosphere, advertising lighting, and outdoor lighting.

The lighting device includes a light emitting device (LED), which is driven through power consumption less than that of a typical lamp lighting device. In particular, the LED can create various scenes by controlling of the switching sequence of a plurality of LEDs, the colors of light emitted from the LEDs, and the brightness of the LEDs.

The above lighting device may be used as an outdoor lighting device, and installed in an outer wall of a building, a park, a street lamp, a bridge rail, or a theater. Lighting devices may be provided in various sizes and various systems according to their purposes, targets, or positions to which the lighting devices are applied.

In other words, when the lighting devices are used on an outer wall of the building, the lighting devices may be simply switched on/off in the shape of a strip on the outer wall of the building or simply represent a single color or combined colors. In addition, lighting devices may be irregularly installed in the park, on the street lamp, or on the bridge rail according to the shape of the target, such that the lighting devices may be variously switched on/off or the colors of the lighting devices may be variously represented.

In addition, when the lighting devices are used in the theater, the lighting devices are installed around the theater or on the theater in the shape of a strip, and are simply switched on/off or simply represent colors in order to make the atmosphere of the theater colorful.

However, the conventional lighting devices are limited to only functions of switching on/off while forming a memorized simple shape or representing memorized simple colors.

SUMMARY

The embodiment provides a lighting device capable of changing the operating state corresponding to surrounding environments, a lighting system including the same, and a method of operating the same.

Meanwhile, the embodiments are not limited to the above object, and those skilled in the art can clearly understand other objects from following description.

According to the embodiment, there is provided a lighting device including a communication unit receiving contents through communication with an outside, a content analyzing unit detecting an output state of the contents by analyzing the contents received through the communication unit, a storage unit storing information of a driving condition of a lighting unit corresponding to the output state of the contents, a controller extracting the information of the driving condition of the lighting unit corresponding to the detected output state of the contents from the storage unit and allowing the lighting unit to operate according to the contents based on the information of the driving condition of the lighting unit, and a lighting unit driver outputting a driving signal used to drive the lighting unit according to a control signal of the controller.

According to the embodiments, there is provided a lighting system including a contents receiving unit receiving contents transmitted from an outside, a lighting device receiving the contents from the contents receiving unit, and driving at least one lighting unit according to an output condition of the contents. The lighting device adjusts at least one of a brightness of the at least one light emitting unit, a switching sequence of the at least one light emitting unit, and a color of a light emitted from the at least one light emitting unit according to the output condition of the contents.

According to the embodiments, there is provided a method of operating a lighting unit including receiving contents transmitted from an outside, detecting an output state of the contents by analyzing the contents, and driving at least one lighting unit according to the contents based on the detected output state of the contents.

As described above, according to the embodiment of the disclosure, the operating state of lighting units can be adjusted according to the image signals, voice signals, or caption signals contained in contents, so that realistic lighting can be expressed in response to various image or voice change in real time.

In other words, the lighting units are operated in synchronization with images and voices, so that dynamic lighting effects can be provided, thereby more improving the satisfaction of the user.

DETAILED DESCRIPTION OF THE EMBODIMENTS

Hereinafter, a transparent display according to the disclosure will be described in detail with reference to accompanying drawings.

The disclosure can be various modified and have various embodiments. Accordingly, specific embodiments are illustrated in drawings and will be described in detail. However, it should be understood to those skilled in the art that the disclosure is not limited to the specific embodiment, but includes all modifications, equivalents, and alternatives of the specific embodiment within the spirit and the technical scope of the disclosure.

As described above, according to the embodiment of the disclosure, the operating state of lighting units can be adjusted according to the image signals, voice signals, or caption signals contained in contents, so that realistic lighting can be expressed in response to various images or voice change in real time. In other words, the lighting units are operated in synchronization with images and voices, so that dynamic lighting effects can be provided.

Figure 1:
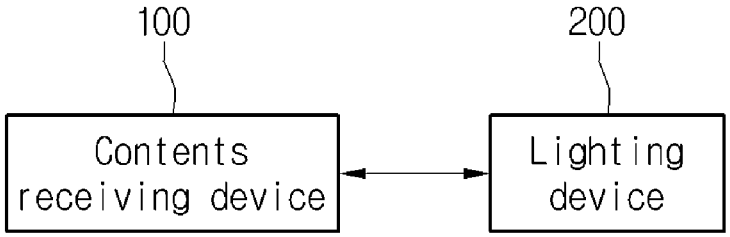
FIG. 1 is a schematic block diagram showing a lighting system according to one embodiment of the disclosure.

FIG. 1 is a schematic block diagram showing a lighting system according to one embodiment of the disclosure.

Referring to FIG. 1, the lighting system includes a contents receiving device 100 to receive contents and a lighting device 200, which communicates with the contents receiving device 100 to receive the contents, and drives at least one lighting unit corresponding to the contents.

The contents receiving device 100 receives contents that have transmitted from an outside. The contents may include image signals, voice signals, and a variety of additional information.

If the contents receiving device 100 receives the contents, the contents receiving device 100 outputs images or voice contained in the contents, and transmits the images or the voice to the lighting device 200. In this case, the contents receiving device 100 may provide original images or original voice to the lighting device 200. In addition, the contents receiving device 100 may analyze the output state of the images or the voice and may provide only information corresponding to the analyzed output state.

The contents receiving device 100 may be realized by using any one of a TV, a radio, a PC, a laptop computer, a tablet PC, a smart phone, a cellular phone, an MP3 player, a DVD player, a PDA, a PMP, a set-top box, and a game device. In other words, the contents receiving device 100 may be realized by using various devices to receive contents (at least one of images or voice).

The lighting device 200 includes at least one lighting unit. Accordingly, the lighting device 200 receives the contents transmitted through the contents receiving device 100 or the output state of the contents, and determines an operating condition of the at least one lighting unit by using the output state of the contents or the contents.

The contents receiving device 100 can make bi-direction communication with the lighting device 200. In this case, the contents receiving device 100 and the lighting device 200 may make data communication with each other through at least one communication scheme of Wi-Fi, Bluetooth, ZigBee, infrared DMX512, and infrared DALI.

Hereinafter, the lighting system will be described in more detail with reference to accompanying drawings.

Figure 2:
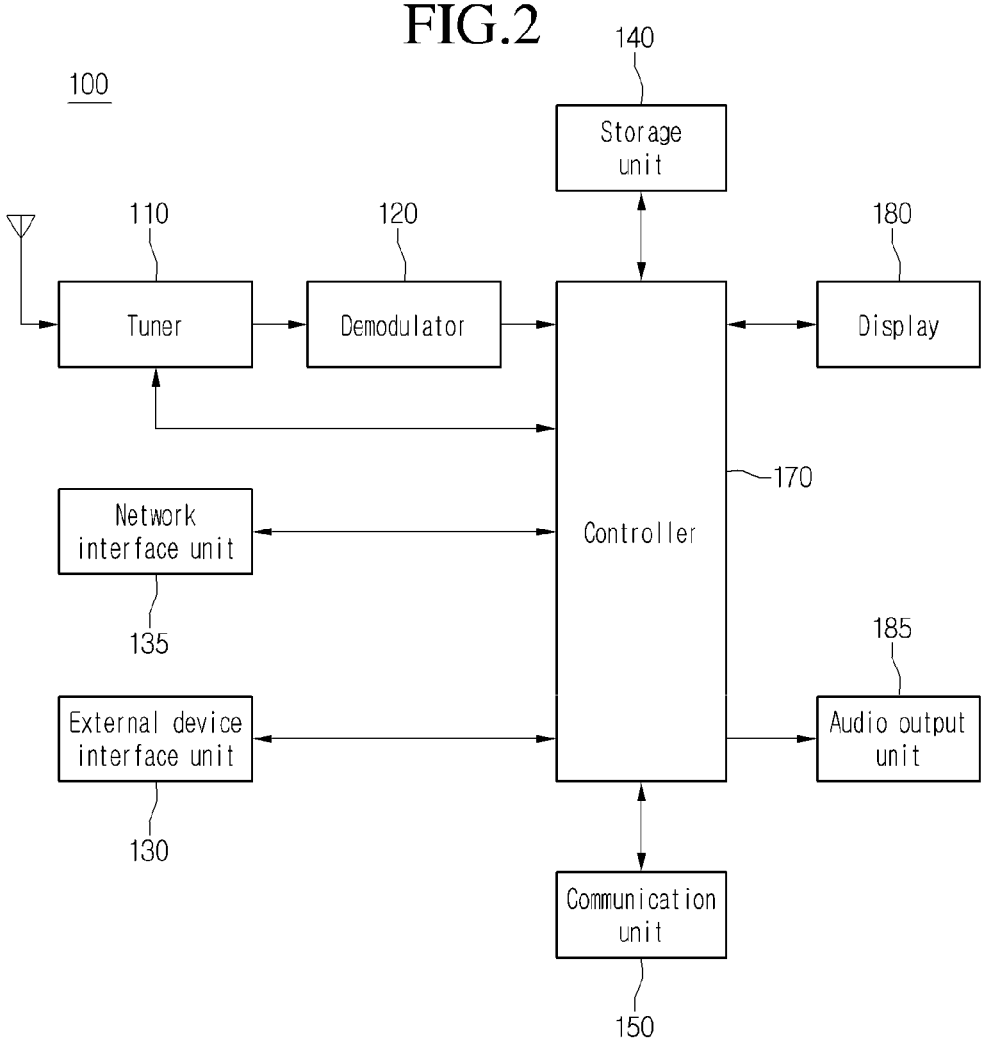
FIG. 2 is a detailed block diagram showing a contents receiving device of FIG. 1.
Figure 3:
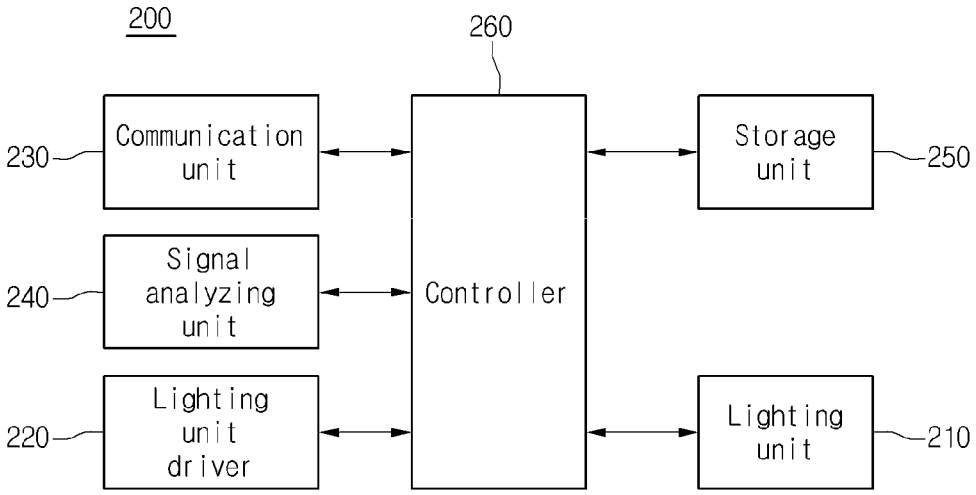
FIG. 3 is a detailed block diagram showing a lighting device of FIG. 1.

FIG. 2 is a detailed block diagram showing the contents receiving device 100 of FIG. 1. FIG. 3 is a detailed block diagram showing the lighting device 200 of FIG. 1.

In this case, the contents receiving device 100 may include various devices to receive at least one of images or voice as described above. However, it is assumed that the contents receiving device 100 is realized as a TV for the convenience of explanation in the following description, Referring to FIG. 2, the contents receiving device 100 may include a tuner 110, a demodulator 120, an external device interface unit 130, a network interface unit 135, a storage unit 140, a communication unit 150, a controller 170, a display 180, and an audio output unit 185.

The tuner 110 selects a channel, which is selected by a user among RF broadcasting signals received through the antenna, or RF broadcasting signals corresponding to all channels that are previously stored. The tuner 110 transforms the selected RF broadcasting signal into an intermediate frequency signal, a base-band image, or a voice signal.

In addition, the tuner 110 may receive an RF broadcasting signal in a single carrier according to an advanced television system committee (ATSC) scheme or an RF broadcasting signals in multiple carriers according to a digital video broadcasting (DVB) scheme.

The demodulator 120 receives and demodulates a digital IF (DIF) signal which is transformed in the tuner 110. For example, if the DIF signal output from the tuner 110 is a signal according to the ATSC scheme, the demodulator 120 performs an 8-vestigal side band (8-VSB) modulation operation. In addition, the demodulator 120 may perform channel demodulation. To this end, the demodulator 120 may include a trellis decoder, a de-interleaver, or a reed Solomon decoder to perform trellis decoding, de-interleaving, or reed Solomon decoding.

The stream signal output from the demodulator 120 may be input to the controller 170. The controller 170 outputs an image to the display 180 and voice to the audio output unit 185 after performing de-multiplexing, and image/voice signal processing.

The external device interface unit 130 may transceive data with the connected external device. To this end, the external device interface unit 130 may include an A/V input/output unit (not shown).

The external device interface unit 130 may be connected with an external device such as a digital versatile disk (DVD), a blue ray, a game device, a camera, a camcorder, or a computer (laptop computer) through a wired/wireless scheme. The external device interface unit 130 transmits an image, a voice, or a data signal, which is input from an outside, to the controller 170 through the external device.

The A/V input/output unit may include a USB connector, a composite video banking sync (CVBS) connector, a component connector, an S-video connector (analog connector), a digital visual interface (DVI) connector, a high definition multimedia interface (HDMI) connector, an RGB connector, and a D-SUB connector, so that the image and the voice signal of the external device may be input to the contents receiving device 100.

The network interface unit 135 provides an interface for the connection purpose with a wired/wireless network including the Internet. The network interface unit 135 may include an Ethernet connector for the connection purpose with the wired network, and may employ a communication standard such as a wireless LAN (WLAN; Wi-Fi), wireless broadband (Wibro), world interoperability for microwave access (Wimax), or high speed downlink packet access (HSPDA).

The storage unit 140 may store programs for processing signals of the controller 170 and control programs of the controller 170, and may store image signals, voice signals, or data signals that are subject to the signal processing.

In addition, the storage unit 140 may temporarily store image signals, voice signals, or data signals input through the external device interface unit 130. In addition, the storage unit 140 may store information of a predetermined broadcasting channel through a channel memory function such as a channel map.

The storage unit 140 may include at least one of a flash memory type storage medium, a hard disk type storage medium, a multimedia card micro-type storage medium, a card memory (e.g., SD or XD memory) type storage medium, a RAM type storage medium, and a ROM (EEPROM) type storage medium. The display 100 may provide files (moving picture files, still image files, music files, or document files) stored in the storage unit 140 to the user by reproducing the files.

The communication unit 150 transmits contents, which are received therein through the tuner 110, the network interface unit 135, and the external device interface unit 130, to the lighting device 200 connected thereto.

In particular, the communication unit 150 may perform wireless communication with the lighting device 200. The communication unit 150 may communicate with the lighting device 100 according to a communication standard such as Wi-Fi, Bluetooth, radio frequency identification (RFID), infrared data association (IrDA), ultra wideband (UWB), ZigBee, or digital living network alliance (DLNA).

In addition, the controller 170 may control the overall operation of the contents receiving device 100.

In particular, if contents are received, the controller 170 performs a control operation such that the received contents are provided to the lighting device 200 and at least one lighting unit is driven according to the contents.

In this case, the controller 170 may detects the output state of the contents by analyzing the contents according to the embodiment and may transmit the output state of the contents to the lighting device 200.

The details of the controller 170 will be described below in more detail.

Referring to FIG. 3, the lighting device 200 includes a lighting unit 210, a lighting unit driver 220, a communication unit 230, a signal analyzing unit 240, a storage unit 250, and a controller 260.

The light emitting unit 210 emits light in response to a lighting driving signal input through the lighting unit driver 220 which is described later. The light emitting unit 210 may be realized by a lighting emitting diode (LED), an organic light emitting diode (OLED), a white LED, or an RGB LED.

The lighting unit driver 220 applies a driving signal to the lighting unit 210 according to the control signal of the controller 260 which is described later.

In other words, the lighting unit driver 220 may apply a driving signal to the lighting unit 210 so that the lighting unit 210 may be driven with the brightness according to the control signal of the controller 260.

In addition, the lighting unit driver 220 may apply the driving signal only to the lighting unit 210 positioned in a specific position among a plurality of lighting units 210 so that only the lighting unit 210 existing in the specific position may be driven.

The communication unit 230 communicates with the contents receiving device 100 to receive contents from the contents receiving device 100.

The communication unit 230 may communicate with the contents receiving device 100 through a communication standard of Wi-Fi, Bluetooth, radio frequency identification (RFID), infrared data association (IrDA), ultra wideband (UWB), ZigBee, or digital living network alliance (DLNA).

The signal analyzing unit 240 analyzes the contents received through the communication unit 230 and detects the output state of the contents according to the analyzing results to output the output state of the contents to the controller 260.

The signal analyzing unit 240 may analyze images contained in the contents according to the embodiment, and may analyze voice contained in the contents.

In other words, the signal analyzing unit 240 divides images contained in contents in the unit of a frame, and calculates an average picture level (ALP) of each frame image.

In addition, the signal analyzing unit 240 divides images, which are contained in the contents, in the unit of a frame, and analyzes each frame image to detect the position of an object positioned in the frame image. In this case, even if a plurality of objects may be contained in the image, the signal analyzing unit 240 may detect the information of the position of any one object among the objects according to a preset analysis condition. The preset analysis condition may include information of a command to primarily detect a person among various objects contained in the image, or to detect an object occupying the most part of the image.

In addition, when the movement of the same object is detected based on the information of the position of the object in each frame image, the signal analyzing unit 240 may detect the information of the moving direction of the object in each frame image together with the information of the position of the object.

In addition, the signal analyzing unit 240 divides images, which are contained in the contents, in the unit of a frame, and analyzes each frame image to recognize information of a color occupying the most part of the frame image.

In this case, even if the signal analyzing unit 240 may detect color information of the whole image, the signal analyzing unit 240 may detect color information of only an image in a specific region by analyzing only the image of the specific region. For example, the signal analyzing unit 240 may track a specific object in the image and detect the color information of only the tracked object.

In addition, the signal analyzing unit 240 may extract voice from the contents and analyze the level of the extracted voice.

The voice level may be analyzed by using any one of the frequency, the tempo, the intensity, the tone, the voice pitch, and the equalizer characteristic of the voice.

The storage part 250 stores information required for the operation of the lighting device 200, or information generated during the operation of the lighting device 200.

In particular, the storage part 250 stores the information of the operating condition of the lighting unit in order to adjust the operating state of the lighting unit corresponding to the output state of the contents.

In this case, the operating condition of the lighting unit includes the brightness information of a lighting unit corresponding to the APL, the position information of the lighting unit to be driven corresponding to the position of the object contained in the image, the color information of the lighting unit corresponding to the color of the image, and the brightness information of the lighting unit corresponding to the voice level.

The controller 260 controls the overall operation of the lighting device 200.

In particular, the controller 260 receives the output state of contents analyzed by the signal analyzing unit 240, reads the operating condition information corresponding to the output state of the received contents out from the storage unit 250, and performs a control operation to operate the lighting unit 210 based on the information of the operating condition of the lighting unit.

In particular, the controller 260 extracts the brightness information of the lighting unit according to the APL of the image and performs a control operation so that the lighting unit 210 is driven with the extracted brightness information.

In addition, the controller 260 outputs a control signal based on the position of an object provided in the image so that only a lighting unit provided in a specific position corresponding to the position of the object is driven.

In addition, if the detected object position is continuously changed, the controller 260 determines the switching sequence of lighting units 210 corresponding to the moving direction of the object and allows the lighting units 210 to sequentially drive according to the switching sequences. The controller 260 switches off the lighting unit 210 positioned corresponding to the previous position of the object if the position of the object is changed.

In this case, if the lighting units 210 are abruptly switched off, the viewing of images may be interrupted. Accordingly, the controller 260 gradually reduces the brightness of the lighting units 210 corresponding to the previous position of the object, so that the light units 210 are gradually switched off.

In addition, the controller 260 determines the color information of the image, and determines light color of the lighting unit 210 based on the determined color information. For example, if the color of the image is yellow, the controller 260 selectively drives only a lighting unit emitting yellow light.

In addition, the controller 260 controls the brightness of the lighting unit 210 according to a voice level analyzed by using at least one of the frequency, the tempo, the intensity, the tone, the voice pitch, and the equalizer characteristic of the voice.

FIGS. 4 to 8 are views showing the driving conditions of the lighting units according to one embodiment of the disclosure. FIGS. 9 to 14 are a flowchart showing a method of operating the lighting units according to one embodiment of the disclosure.

Figure 9:
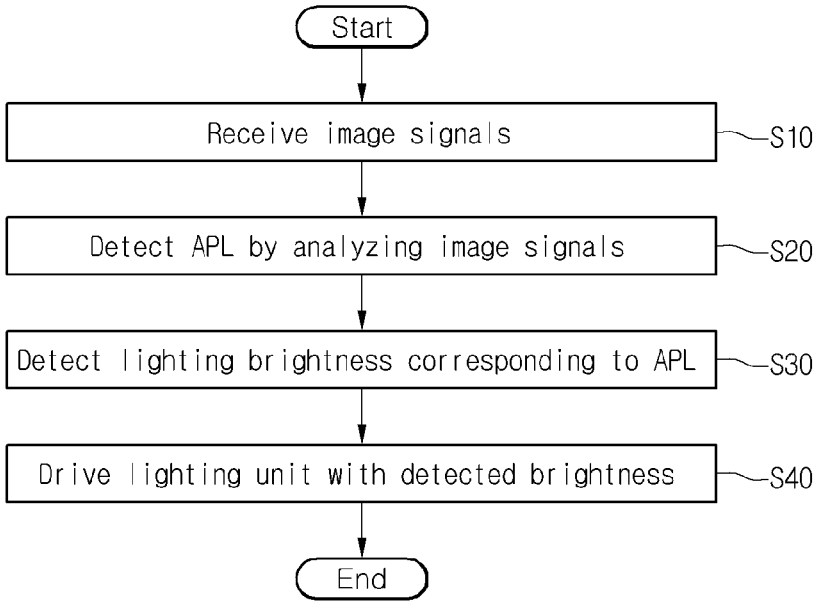
FIGS. 9 to 14 are flowcharts a method of operating lighting units step by step according to one embodiment of the disclosure.

First, referring to FIG. 9, the lighting device 200 receives contents transmitted through the contents receiving device 100 (step S10). The lighting device 200 individually extracts only images from the contents if the contents are received in the lighting device 200.

If the images are extracted, the lighting device 200 analyzes the images, and calculates an APL of each frame (step S20).

The APL may be found by dividing each frame image in the unit of a pixel, calculating the picture level of the divided image of each pixel, and calculating the average of the picture level.

After the APL of the image has been calculated, the lighting device 200 determines the brightness information of the lighting unit corresponding to the APL (step S30). To this end, the lighting device 200 stores the brightness information of the lighting unit according to the APL in the form of a table.

Thereafter, if the brightness information of the lighting unit 210 is determined, the lighting unit 210 is driven based on the determined brightness information (step S40).

In this case, the brightness of the lighting unit 210 can be adjusted proportionally to or inverse proportionally to the APL of the image.

Figure 4:
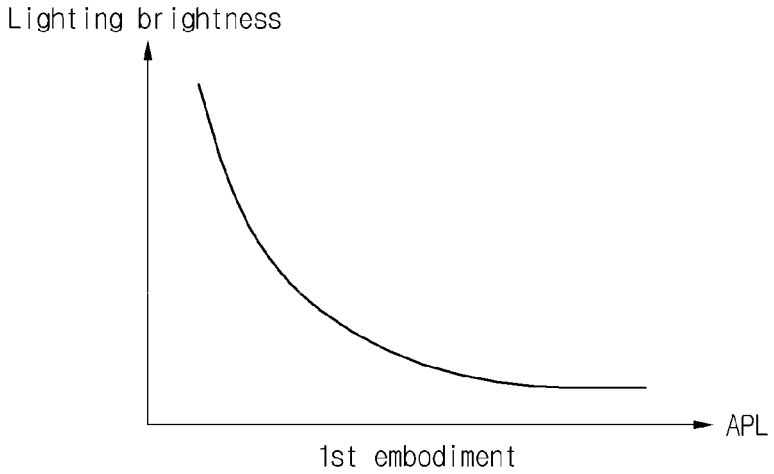
FIGS. 4 to 8 are views showing the driving condition of a lighting unit driving conditions according to one embodiment of the disclosure.
Figure 4:
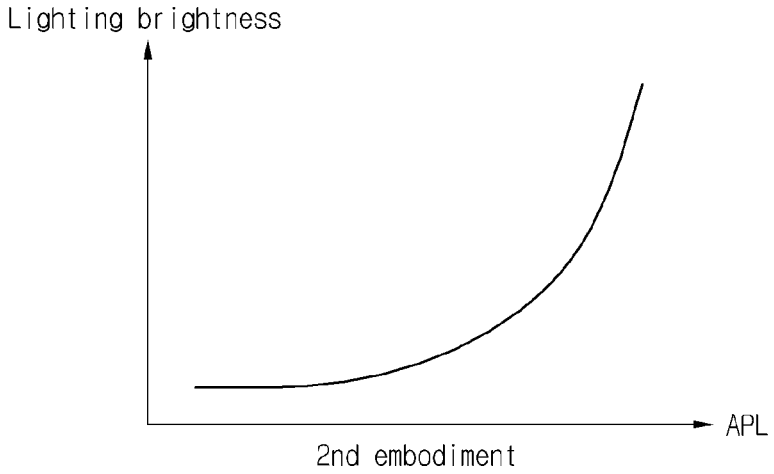

Referring to FIG. 4, according to the first embodiment, the brightness of the lighting unit 210 is adjusted reverse proportionally to the APL of the image. In other words, according to the first embodiment, if the APL of the image is increased, the brightness of the lighting unit 210 is reduced. In contrast, if the APL of the image is decreased, the brightness of the lighting unit 210 is increased.

In addition, according to the second embodiment, the brightness of the lighting unit 210 is adjusted proportionally to the APL of the image. In other words, according to the second embodiment, if the APL of the image is increased, the brightness of the lighting unit 210 is increased. In contrast, if the APL of the image is reduced, the brightness of the lighting unit 210 is reduced.

Figure 10:
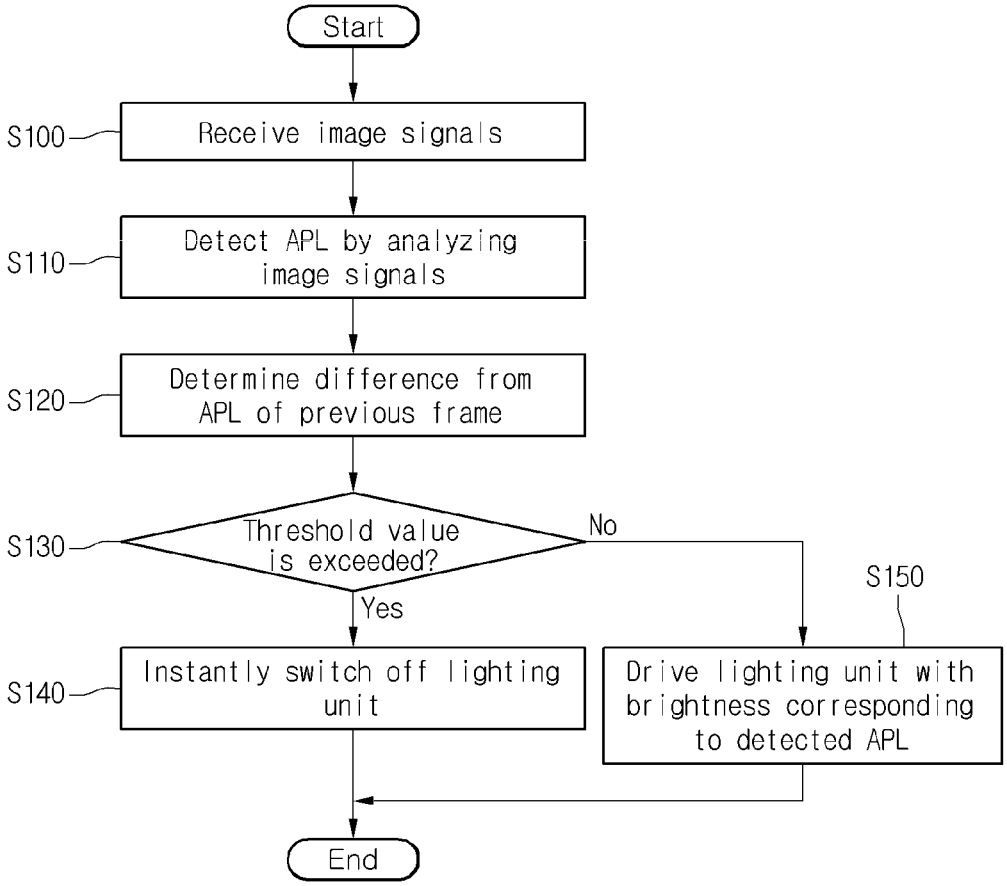

Next, referring to FIG. 10, the lighting device 200 receives contents transmitted through the contents receiving device 100 (step 100). The lighting device 200 individually extracts only an image from the received contents if the contents are received.

If the image is extracted, the lighting device 200 analyzes the image and calculates the APL of each frame image (step S110).

After dividing each frame image in the unit of a pixel and calculating the picture level of the divided image of each pixel, the average of the picture level is calculated, thereby finding the APL.

Thereafter, the lighting device 200 compares the APL corresponding to a present frame corresponding to a previous frame (step S120).

The lighting device 200 determines if the difference between the two APLs exceeds a preset threshold value according to the comparison result (step S130). In other words, the lighting device 200 determines if the brightness of the received image is abruptly changed.

If the difference between the two APLs exceeds the preset threshold value according to the determination result in step S130, the lighting device 200 immediately switches off the lighting unit 210 (step S140).

In addition, if the difference between the two APLs is less than the preset threshold value according to the determination result in step S130, the lighting device 200 controls the brightness of the lighting unit 210 is controlled according to the APL of the present frame (step S150).

Figure 5:
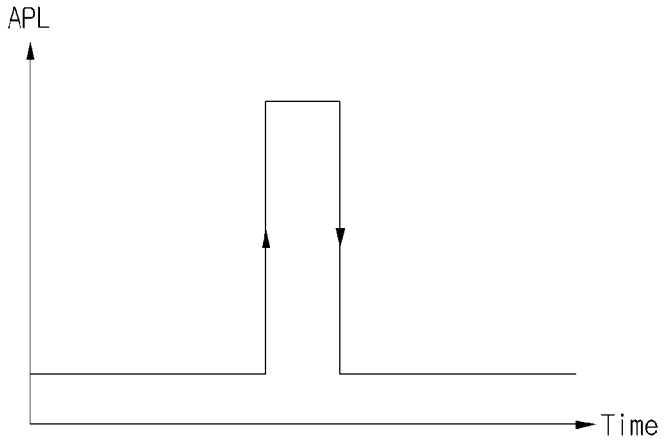

In other words, referring to FIG. 5, if the APL of an image is abruptly changed from a first level to a second level, the lighting device 200 determines that a lightning scene is contained in present contents. Accordingly, the lighting effect corresponding to the lightning scene is expressed by immediately switching off the lighting unit 210.

Figure 11:
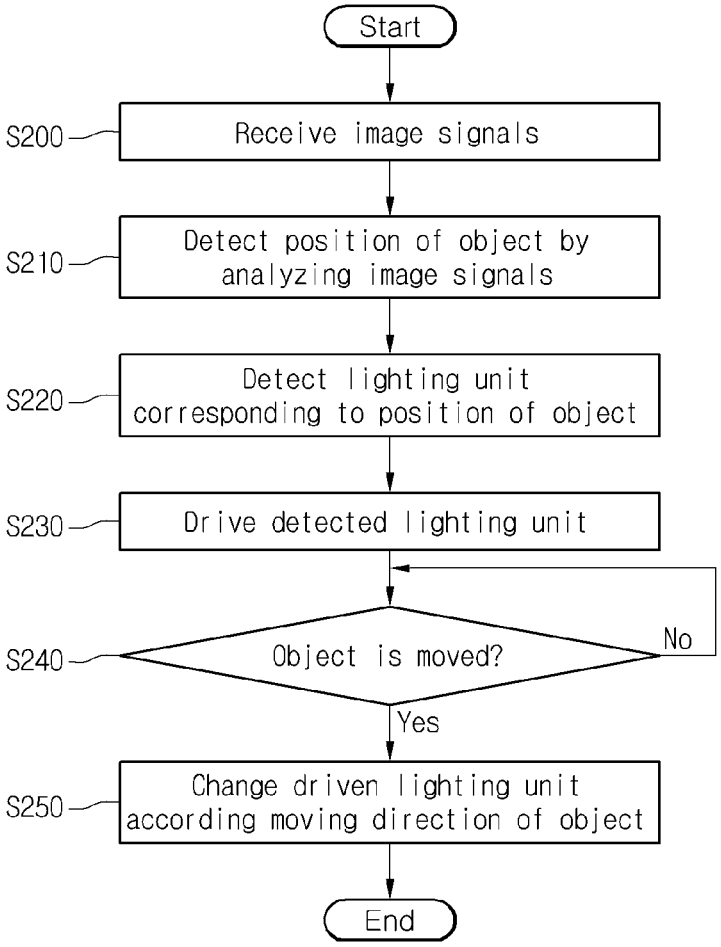

Thereafter, referring to FIG. 11, the lighting device 200 receives contents transmitted through the contents receiving device 100 (step S200). The lighting device 200 individually extracts only images from the received contents if the contents are received.

If the images are extracted, the lighting device 200 analyzes the images, and detects the position of an object contained in the contents (step S210). Since the scheme of detecting the position of the object is generally known to those skilled in the art, the details thereof will be omitted.

If the position of the object is detected, a lighting unit corresponding to the position of the object is detected (step S220).

Thereafter, the detected lighting unit is driven (step S230).

Figure 6:
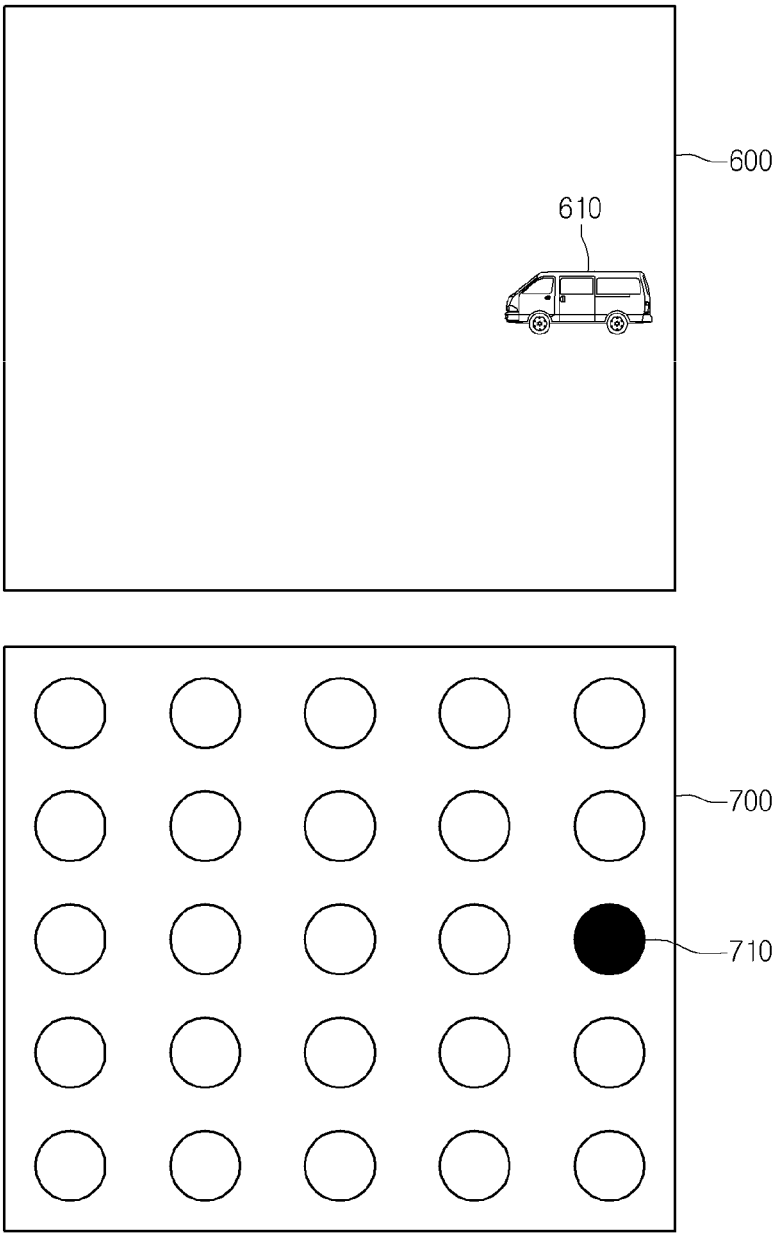

In other words, referring to FIG. 6, an object 610 is provided at a first position of a received image 600. Accordingly, the lighting device 200 detects the position of the object 610 in the image 600.

If the position of the object 610 is detected, the lighting device 200 detects the lighting unit corresponding to the position of the object 610.

Figure 7:
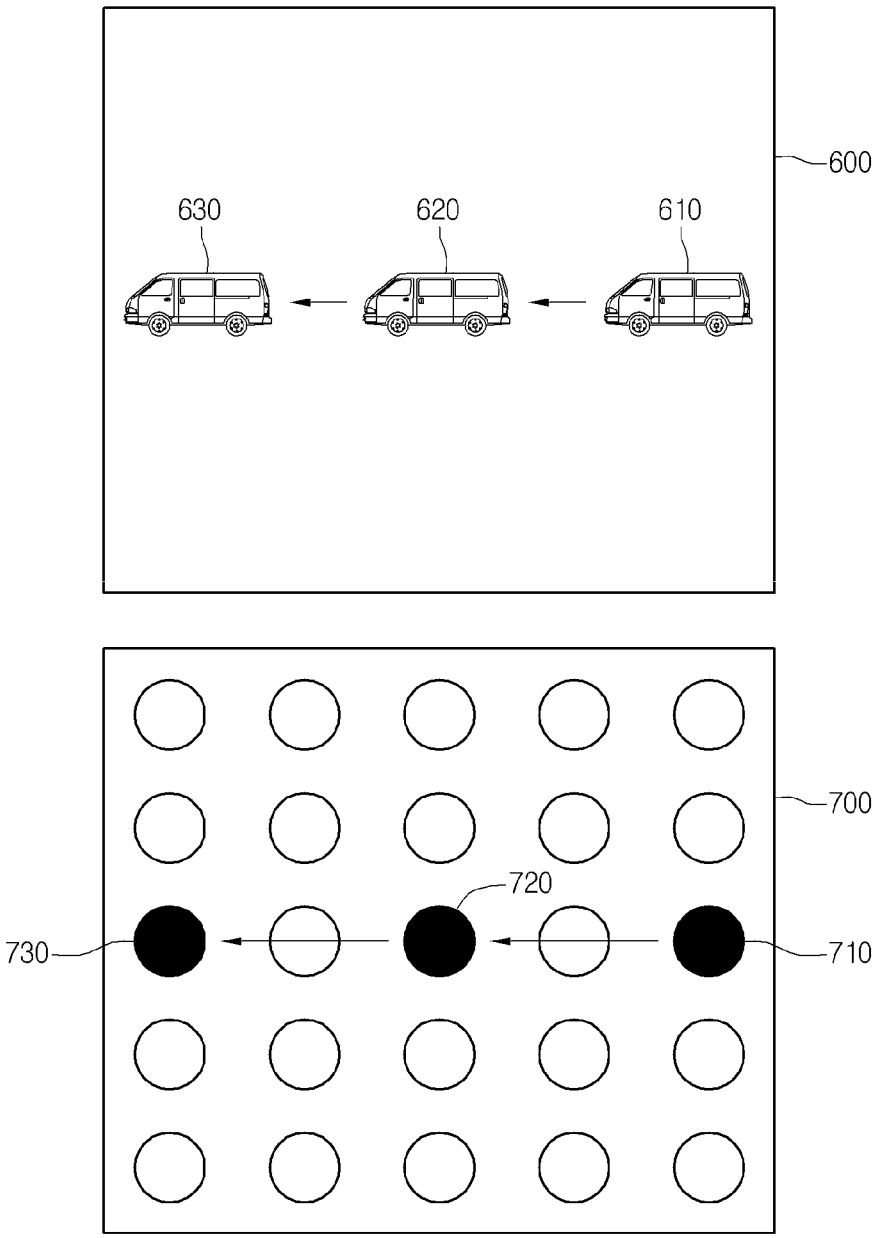

For example, as shown in FIG. 7, a plurality of lighting units are provided in a block 700, and a position 710 of a lighting unit may be detected corresponding to the position of the object 619. Therefore, the lighting unit provided at the position 710 is switched on.

In other words, only a lighting unit formed at a specific position corresponding to the position of the object contained in the image is selectively switched on.

Thereafter, the movement of an object is determined (step S240). In other words, a determination is made regarding if the position of an object detected in a previous frame is different from a position of an object detected in a present frame.

If the movement of the object is determined, the lighting device 200 determines the switching sequence of lighting units based on the moving direction of the object (step S250).

In other words, as shown in FIG. 7, if an object is moved from a first position 610 to a second position 620, and then moved from the second position 620 to a third position 630, the lighting device 200 primarily switches on a first lighting unit 710 provided at a position corresponding to the first position 610. Thereafter, second and third lighting units 720 and 730 corresponding to the second and third positions 620 and 630, respectively, are sequentially switched on.

For example, if an object is displayed at the first position 610, the first lighting unit 710 is switched on. If the object is displayed at the second position 620, the second lighting unit 720 is switched on. If the object is displayed at the third position 630, the third lighting unit 730 is switched on.

In this case, as the object is displayed at the second position 620, if the lighting device 200 switches off the first lighting unit 710, and instantly switches on the second lighting unit 720, a user may feel inconvenience as the first lighting unit 710 is abruptly switched off. Accordingly, when the second lighting unit 720 is switched on, the brightness of the first lighting unit 710 is gradually reduced.

Figure 12:
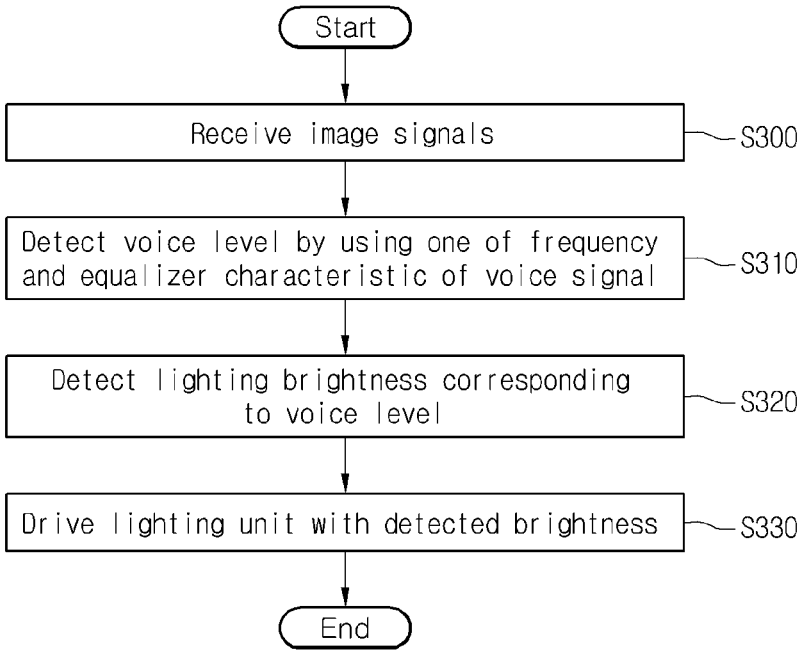

Referring to FIG. 12, the lighting device 200 receives contents and extracts a voice signal from the contents (step S300).

Thereafter, the lighting device 200 determines the level of the voice signal by using the tempo, the intensity, the tone, and the voice pitch of the voice signal as well as the frequency and the equalizer characteristic of the voice signal (step S310).

If the voice level is determined, the lighting device 200 detects the brightness of the lighting unit corresponding to the determined voice level (step S320).

Thereafter, the lighting device 200 drives the lighting unit 210 with the detected brightness (step S330).

Figure 8:
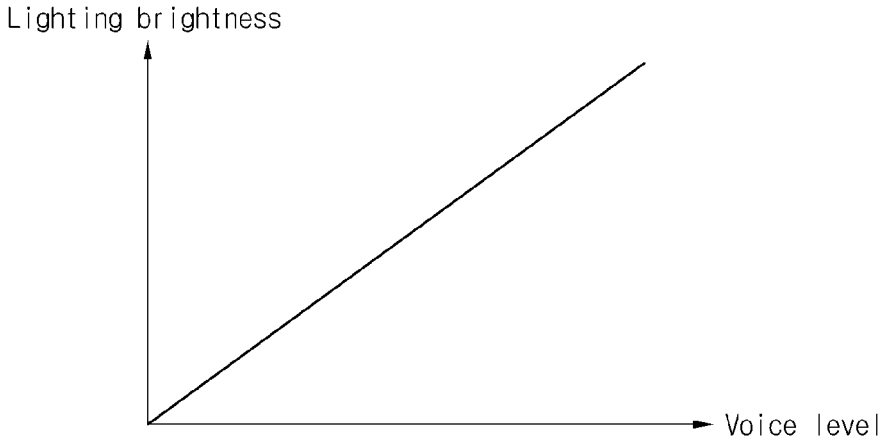

As shown in FIG. 8, the lighting device 200 adjusts the brightness of the lighting unit 210 proportionally to the determined voice level if the voice level is determined.

Figure 13:
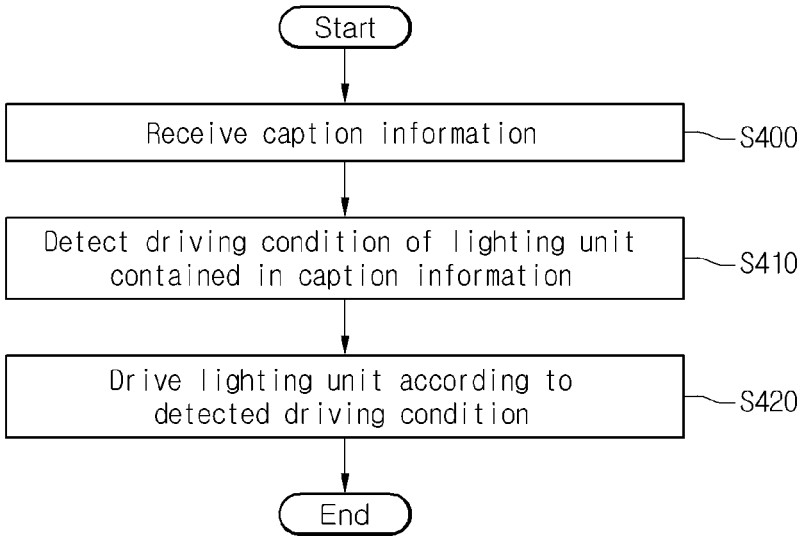

Thereafter, referring to FIG. 13, the lighting device 200 extracts caption information from the contents (step S400). The caption information includes operating condition information of the lighting unit which operates according to the contents together with the contents.

Then, the lighting device 200 determines the driving condition of the lighting unit according to the detected caption information (step S410).

Thereafter, the lighting device 200 drives the lighting unit based on the determined driving condition of the lighting unit (step S420).

Figure 14:
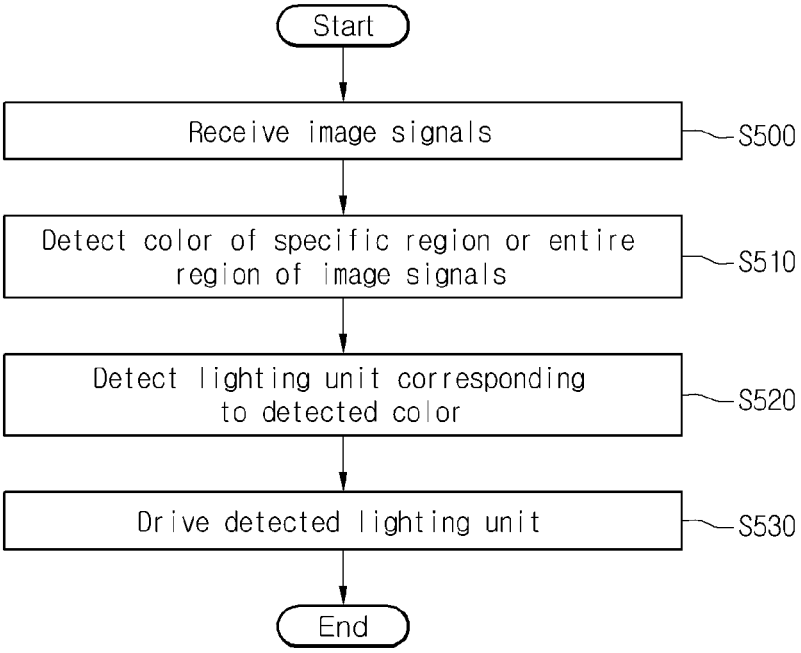

Thereafter, referring to FIG. 14, the lighting device 200 receives contents and extracts an image of each frame from the contents (step S500).

Thereafter, the lighting device 200 determines the color of each extracted frame image (step S510).

In this case, the lighting device 200 may detect the average color of the full image of each frame. In addition, the lighting device 200 may detect only an average color of a specific region of the frame image. For example, the lighting device 200 may detect only the color of an object contained in the image.

Thereafter, the lighting device 200 detects the lighting unit corresponding to the detected color (step S520). For example, the lighting device 200 detects a lighting unit emitting light having a color the same as that of the image.

The lighting device 200 drives the detected lighting unit (step S530).

For example, if the scene of the sea is contained in a present image, the lighting device 200 allows a lighting unit emitting blue light to emit the blue light. If a yellow vehicle is contained in the image, only a lighting unit emitting yellow light may emit the yellow light.

According to the embodiment of the disclosure, the operating states of lighting units can be adjusted according to the image signals, voice signals, or caption signals contained in contents, so that realistic lighting can be expressed in response to various image or voice variation in real time.

In other words, the lighting units are operated in synchronization with images and voices, so that dynamic lighting effects can be provided, thereby more improving the satisfaction of the user.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A lighting device comprising:

a contents receiving unit receiving contents from an outside source;

lighting units comprising a first lighting unit and a second lighting unit; and a controller controlling a first switching sequence of the lighting units and a second switching sequence of the lighting units based on a frequency, a tempo, and an intensity of an audio signal included in the contents and allowing the lighting units to sequentially drive according to the switching sequences;

wherein the lighting units are physically separated from the contents receiving device;

wherein the controller controls the first switching sequence of the lighting units by switching the lighting units on or off, separately, and the second switching sequence of the lighting units by switching the lighting units on or off, together;

wherein the second lighting unit is turned off by the first switching sequence when the first lighting unit is turned on; and wherein the controller further controls the brightness of the lighting units based on the frequency, the tempo, and the intensity of the audio signal included in the contents.

2. A method of operating lighting units, the method comprising:

receiving contents transmitted from an outside source;

detecting an audio signal included in the contents;

determining a first switching sequence and a second switching sequence of the lighting units according to the contents based on a frequency, a tempo, and an intensity of the audio signal included in the contents;

driving the lighting units according to the first switching sequence and the second switching sequence; and controlling the brightness of the lighting units based on the frequency, the tempo, and the intensity of the audio signal included in the contents;

wherein the first switching sequence comprises switching the lighting units on or off, separately;

wherein the second switching sequence comprises switching the lighting units on or off, together;

wherein the lighting units comprise a first lighting unit and a second lighting unit, and wherein the second lighting unit is turned off by the first switching sequence when the first lighting unit is turned on.

3. A lighting device comprising:

a contents receiving unit receiving contents through communication with an outside source;

a content analyzing unit detecting an output state of the contents by analyzing the contents received through the contents receiving unit;

a plurality of lighting units; and a controller driving the lighting units based on the detected output state of the contents;

wherein the detected output state of the contents used to drive the lighting units includes information of a position of an object included in an image of the contents, and driving the lighting units includes switching one or more of the lighting units on or off based on the detected output state of the contents;

wherein, if the object included in the image is stationary, the controller allows the lighting unit of the plurality of lighting units corresponding to the position of the object to remain switched on while all lighting units of the plurality of lighting units that do not correspond to a position of an object in the image are switched off; and wherein, if the object included in the image is moved, the controller switches on a lighting unit of the plurality of lighting units corresponding to a present position of the object, and switches off, by gradually reducing brightness thereof, a lighting unit of the plurality of lighting units corresponding to a previous position of the object.

* * * * *